US006302976B1

(12) United States Patent
Heinonen-Person

(10) Patent No.: US 6,302,976 B1
(45) Date of Patent: Oct. 16, 2001

(54) METHOD OF SURFACE TREATING HIGH-STRENGTH ALUMINUM

(75) Inventor: Esko Heinonen-Person, Eslöv (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/367,310

(22) PCT Filed: Feb. 18, 1998

(86) PCT No.: PCT/SE98/00288

§ 371 Date: Oct. 12, 1999

§ 102(e) Date: Oct. 12, 1999

(87) PCT Pub. No.: WO98/36853

PCT Pub. Date: Aug. 27, 1998

(30) Foreign Application Priority Data

Feb. 20, 1997 (SE) ..... 9700593

(51) Int. Cl.[7] ..... B05D 7/14; C22F 1/04
(52) U.S. Cl. ..... 148/537; 148/698; 148/701
(58) Field of Search ..... 148/516, 537, 148/698, 699, 700, 701

(56) References Cited

U.S. PATENT DOCUMENTS 4,818,302 * 4/1989 Wefers et al. ..... 148/537
5,858,133 * 1/1999 Keener ..... 148/537

FOREIGN PATENT DOCUMENTS 0 297 561 1/1989 (EP) .
1 540 151 2/1979 (GB) .

* cited by examiner

*Primary Examiner*—George Wyszomierski
(74) *Attorney, Agent, or Firm*—Burns, Doane, Swecker & Mathis, L.L.P.

(57) ABSTRACT

The disclosure relates to a method of coating a high-strength aluminum object with polymer and surface-treating it, for improved corrosion resistance. A polymer composition is coated onto the surface of the aluminum object and is sintered or melted fast, at the same time as solution treatment for precipitation hardening takes place. The polymer composition substantially comprises a fluorine-containing polymer, preferably PTFE. According to one preferred embodiment of the invention, the polymer coating is sintered or melted fast on the aluminum surface during a time period of approx. 15 minutes at approx. 420 degrees C. After solution treatment and simultaneous surface treatment at elevated temperature, the aluminum object is rapidly cooled to room temperature and precipitation hardened thereafter by means of artificial aging preferably at approx. 120–150 degrees C. for approx. 24 hours.

13 Claims, 1 Drawing Sheet

METHOD OF SURFACE TREATING HIGH-STRENGTH ALUMINUM

TECHNICAL FIELD

Figure 1:
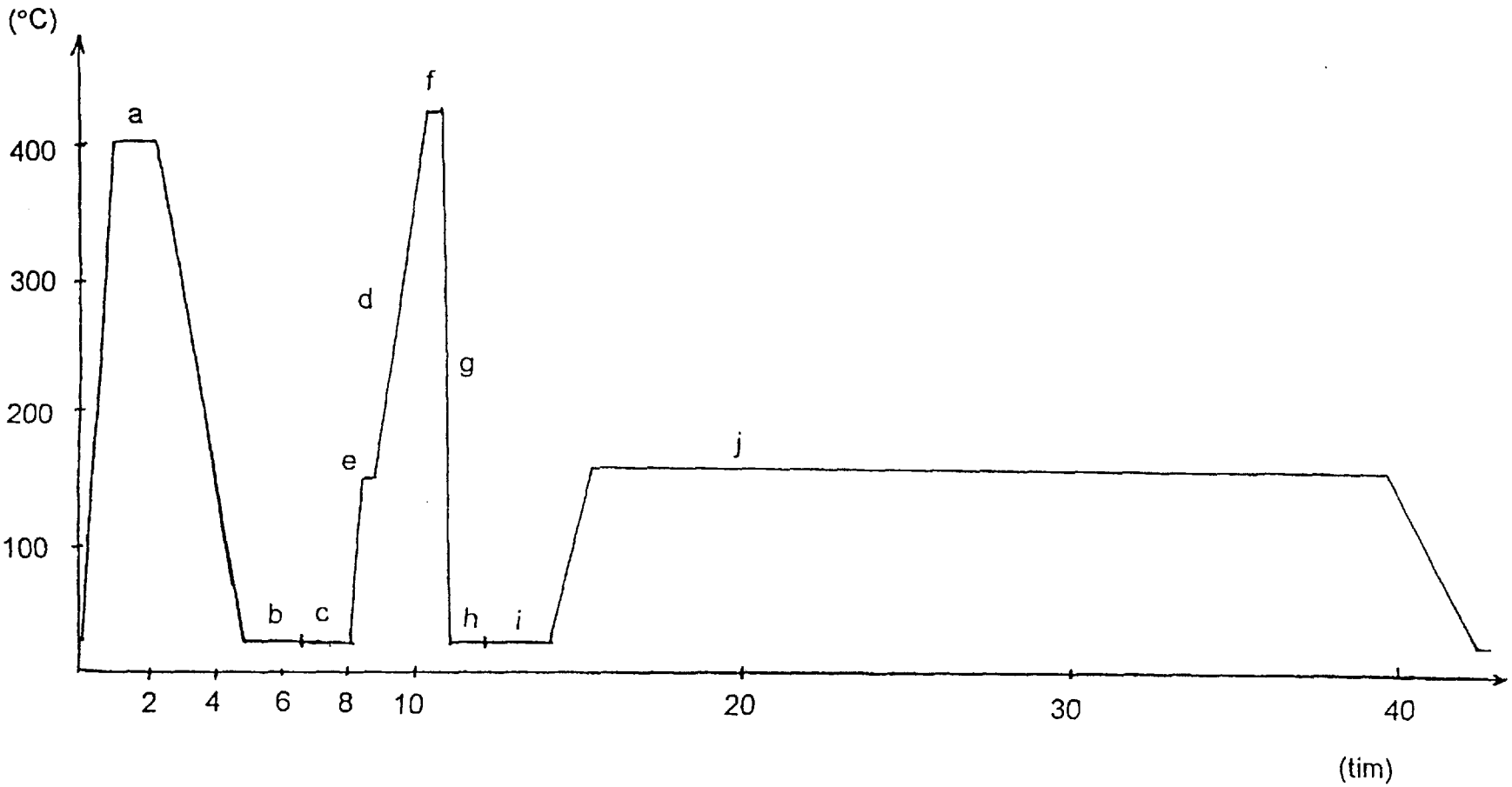

The present invention relates to a method of coating with polymer and surface treating an object of high-strength aluminium.

BACKGROUND ART

Objects of high-strength aluminium are often used as structural materials for machine parts on which demands are placed for light weight and high strength, for example in aircraft structures.

High-strength aluminium is obtained by precipitation hardening (or so-called age hardening) of a so-called heat treatable aluminium alloy by a two-stage heat treatment process. In the first stage, during the so-called precipitation treatment, the material is heated to an elevated temperature at which all alloy components are dissolved in the crystal lattice structure of the aluminium and are transformed into so-called solid solution. The greater the proportion of alloy components which the alloy contains, the higher will be the temperature required for solution. The solution treatment is terminated in that the object is rapidly cooled with water, water mist or air. In the second stage, during the so-called ageing process, hardening precipitations are formed in the material. Ageing of high-strength aluminium takes place at elevated temperature for a relatively short time, so-called artificial ageing, as opposed to so-called cold ageing, i.e. ageing at room temperature over a relatively lengthy period of time.

Aluminium material is generally highly resistant to corrosion in a neutral environment because of the fact that the aluminium surface is oxidised and the thus formed oxide layer is relatively corrosion-resistant. In acidic (pH<4) and alkaline (pH>9) environments, this oxide layer becomes, however, unstable and so the material corrodes.

In order to achieve improved corrosion resistance, machine parts and structures for use in acidic or alkaline environments can be surface treated by means of coating with a suitable chemical-resistant polymer possessing superior internal strength and adhesion to the surface of the aluminium object, such as, for example, polymers containing fluorine. Fluorine-containing polymers normally also possess superior thermal resistance, which is an advantage in many fields of practical application.

One particular field of application for such polymer-coated corrosion-resistant aluminium objects is machine pats in filling machines intended for the packing of liquid foods of the type which fills, forms and seals packages in the same machine. In the handling of foods, extremely high demands are placed on hygiene and cleanliness, these demands being satisfied in that those parts of the machines which are in direct content with the food are regularly cleaned (i.e. at least once a day) by means of efficient detergents or cleaning agents. Such cleaning agents often contain alkaline chemicals. In cleaning, it is inevitable that detergents and cleaning liquids splash and drop onto other parts of the machine. In particular, machine parts which are included in the sealing unit such as, for example, sealing jaws, are often located beneath the filler pipe and the conduits which lead to and from the filler unit, which, on cleaning of the filler unit, inevitably results in cleaning agent dripping down onto these machine parts.

Surface treatment of high-strength aluminium by means of polymer coating today is put into effect in that the finished, already precipitation hardened and ready-to-use aluminium object is coated with a layer of polymer and then heated to elevated temperature in order to sinter or melt the polymer coating fast to the aluminium surface. How high the temperature which is to be selected is a matter of discretion taking into account the properties of the polymer and the temperature resistance of the aluminium. The term sintering (also known as agglomeration) is taken to signify the physical process which takes place when more or less solid material particles bond or frit to one another by molecular diffusion in the surface layer and thus "migrate together" to form a continuous microporous network.

Commercially available polymer compositions with a high melting point and which are sintered at high temperatures such as, for example, approx. 400° C. display generally better adhesion, mechanical properties and resistance to chemicals. Heating to such elevated temperatures entails, however, that the aluminium material loses both hardness and mechanical strength by more than 50% up to approx. 65–75%. In practice, polymers are therefore employed which melt and sinter at lower temperatures, such as, for example, at approx. 200° C. Coatings of such polymers unfortunately display poorer adhesion to the aluminium surface and, as a result, afford a poorer corrosion protection, while, on the other hand, the hardness and mechanical strength of the aluminium object are retained on heating up to at most approx. 200° C.

Even though such plastic-coated machine parts of high-strength aluminium today constitute the most corrosion-resistant alternatives on the market which also satisfy other design and construction requirements, they must be replaced after a relatively short service life because the polymer coating has been attacked and weakened by the alkaline substances and no longer affords blanket protection for the aluminium object which, as a result, will be destroyed by corrosion. It is, thus, an as yet unsolved problem within the prior art technology to surface-coat objects of high-strength aluminium in order to achieve improved corrosion resistance to a sufficiently high degree without negatively influencing the mechanical strength and durability properties of the aluminium object.

OBJECTS OF THE INVENTION

One object of the present invention is, therefore, to realise a novel method of surface-treating objects of high-strength aluminium as described by way of introduction, without consequential problems of the type inherent in the prior art technology.

A further object of the present invention is to realise a method of producing surface-treated objects of high-strength aluminium with improved corrosion resistance.

A particular object of the present invention is to realise a method of producing objects of high-strength aluminium possessing improved corrosion resistance and retained pristine high strength and superior mechanical properties.

Still a further object of the present invention is to realise a corrosion-resistant object of high-strength aluminium which is surface-treated with polymer and is produced using the method according to the present invention.

SOLUTION

These and other objects will be attained according to the present invention by the method which carries the characterizing features as set forth in the characterizing clause of appended claim 1. Variations and modifications of the method according to the present invention are apparent from appended subclaims 2 to 12.

Further, the present invention realises surface-treated objects of high-strength aluminium according to appended claim 13, with improved corrosion resistance and retained pristine mechanical properties.

OUTLINE OF THE INVENTION

In so-called heat-treatable aluminium alloys, one or more of the alloy components are selected such that a strength increase is achieved by precipitation hardening, also called age hardening. The precondition for precipitation hardening to be able to take place is that the solubility of the added alloy components in aluminium reduces with falling temperature. Thus, precipitation hardening is achieved by solution treating, in a first stage, i.e. for a relatively short time heating the heat-treatable aluminium alloy to such an elevated temperature that the added alloy components merge into solid solution within the aluminium structure, and subsequently rapidly cooling the alloy so that a saturated solution of alloy atoms in the aluminium material remains and, thereafter, in a second stage ageing the aluminium alloy for a relatively long period of time, when the actual precipitation takes place, for the formation of small finely dispersed precipitations distributed in the basic material.

Thus, the present invention relates to corrosion protection surface treatment of, primarily, so-called high-strength aluminium, which relates to a group of heat-treatable alloys, normally containing copper (Cu) and magnesium (Mg) which, by precipitation hardening, are given higher strength and mechanical properties. Different alloy compositions for producing high-strength aluminium are known to persons skilled in the art. For example, precipitation hardened alloys containing zinc (Zn), magnesium (Mg) and copper (Cu) as alloy metals, AlZnMgCu alloys being numbered among this group.

The corrosion-protecting surface treatment is realised by coating the surface of the aluminium object with a polymer with improved adhesion- and strength properties and resistance to chemicals. Preferably, polymer compositions containing fluorine are employed. Fluorine polymers suitable for this purpose are known to persons skilled in the art and need not be specified further here, but a well-functioning example of such a polymer is polytetrafluouroethylene (PTFE). As adhesive or binding agent in such PTFR-based polymer compositions, heat-resistant polymers such as polyphenylene sulphide (PPS) or polyethersulphone (PES) may be employed. At the sintering temperature, for example approx. 400° C., these heat resistant polymers stratify to the metal surface and give adhesion and hardness.

Hence, according to the method according to the present invention, such polymers are melted or sintered fast to the surface of the heated aluminium object at elevated temperatures in the same heating stage as the above-mentioned solution treatment, thus avoiding the necessity of heating the aluminium object in an additional surface coating stage after the precipitation hardening.

The method according to the invention is applicable to all aluminium alloys which may be solution treated at such elevated temperatures which the polymer composition selected for final use requires for good sintering and adhesion to the aluminium surface and, vice versa, with all polymer compositions which may afford a good corrosion protection after sintering fast at the solution temperature which each respective aluminium alloy requires.

Each alloy, with its specific composition of alloy components and quantities of them, places different demands on temperatures, stay times and heating and cooling speeds, respectively. For example, the heating to the solution temperature may be made in one or several stages during varying time intervals, the stay time at the solution temperature may be adapted to the composition and functional requirements of the alloy and the polymer, respectively, and the cooling speed may be varied within the framework of the cooling time and cooling speed dependent properties of each respective alloy. The choice of time and temperature for the ageing process is also varied in response to the properties of each respective alloy. The ageing process normally takes place at one and the same temperature, buy may also be carried out in one or more stages at different temperatures. For example, a shorter ageing interval at room temperature may be carried out, a so-called cold ageing stage, before artificial ageing is commenced.

Before the aluminium surface is coated with polymer, it should be cleaned and prepared for surface treatment in order to obtain optimum adhesion. This is ideally realised by first heating the aluminium surface to elevated temperature such as, for example, approx. 400° C. for burning off organic residues, such as fat and the like, and then sand blasting the surface.

Preferably, the polymer composition is applied in the molten form or in the form of powder by means of known techniques, such as, for example, thermal spraying (also known as flame spraying), on the surface of the aluminium object before heating to the solution temperature takes place. It is naturally also conceivable to apply the composition in other manners, such as, for example, in the form of a solution or dispersion which is dried and thereafter melted and/or sintered fast on the aluminium surface. Application may also take place during the heating process proper or during the solution time at the solution temperature, with an appropriately adapted process. The polymer coating may be applied in one or more stages, possibly divided into primer and top layer, in which event the polymer composition may be varied for the different layers.

The thickness of the polymer composition is adapted to the requirements of end-use and may, for example, be varied between 10 and 100 $\mu$m.

Heating to the solution temperature most appropriately takes place in ovens with accurate temperature control, normally air circulation ovens, so-called convection ovens. The heating should take place as rapidly and uniformly as possible in the aluminium material as possible, for which reason it is appropriate if the oven is pre-heated to the solution temperature already when the material object is inserted in place. The heating time may vary from a few minutes to a couple of hours, depending on the thickness of the material object and the capacity of the oven.

It is important to carefully follow the temperature limits in solution treatment. Too low a temperature will result in poor solution and poor strength, while too high a temperature may result in discoloration, blister formation or the initiation of melting. The temperature of the material is normally held at the solution temperature for approx. 15–60 minutes, depending upon the temperature properties of the alloy and the polymer coating, coarser precipitations which had previously been formed in the material being then dissolved.

In such cases where the alloy requires a longer time or higher temperature than the polymer composition can withstand, the aluminium material may first be partly solution treated, whereafter the polymer composition is applied so as to be melted/sintered fast during the final phase of the solution treatment.

The solution-treated aluminium material object must thereafter be cooled so rapidly that no precipitation has time to take place and the alloy additives remain in an oversaturated solid solution, which is precondition for the final strength of the material to be sufficiently high. Certain alloys are considerably more sensitive for sufficient cooling speed than others, in order to achieve maximum strength after the precipitation hardening. For example, alloys of the 7075 type, which have a very demanding dependence on cooling time and cooling speed, require a cooling speed of at least 300° C./s. Cooling normally takes place in water, but may also be put into effect using water spraying or air cooling, among other things depending on the thickness of the material. What is crucial is that the cooling takes place rapidly and that the temperature of the coolant is maintained more or less constant.

The ageing stage is thereafter carried out by storage at room temperature (cold ageing) or at elevated temperature (artificial ageing). The alloy atoms which are in oversaturated solution in the material after the solution treatment form, by diffusion, minor precipitations which increase the strength of the material. Thus, the ageing process takes place already at room temperature, but is slow. In order to entirely inhibit the ageing process in the material for a short time, it may be stored at a temperature lower than −15° C. Ageing at elevated temperature generally gives a sufficiently fine precipitation distribution in a reasonable time and, as a rule, gives maximum strength. Further improved strength may be obtained by causing the material to cold age a short time before the artificial ageing. It generally applies in this context that a higher ageing temperature permits a shorter ageing time, but with a certain loss of strength. Some alloys age sufficiently over a reasonable time (a few days) at room temperature, while other alloys are always artificially aged. The above-mentioned 7075 alloys are artificially aged, for example, often at approx. 120° C. Artificial ageing temperatures normally vary between 100 and 200° C., while artificial ageing times normally vary between 5 and 48 hours. Longer times and higher temperatures generally result in larger, but fewer precipitation particles. Thus, it is a matter of optimising the ageing cycle and thereby the size and distribution of the precipitations for each respective aluminium alloy so that an optimum balance of the properties of the material is achieved. Maximum tensile strength must, as a rule, be set off against a certain loss of, for example, corrosion resistance. The degree of hardening in artificially aged alloys is disclosed by T-designations, such as, for example, T5 to T10. Hardening degrees T6 and T7 are given for materials which, after solution treatment and cooling, have been treated with precipitation artificial ageing. T6 hardened aluminium material has, as a rule, the highest possible strength practically without losing any other key properties. T7 material is so-called "over-aged" at generally higher artificial ageing temperatures as compared with T6 material of the same alloy, which permits higher dimensional stability in use at higher temperatures in, for example, engine parts.

BRIEF DESCRIPTION OF THE ACCOMPANYING DRAWING

The present invention will now be described in greater detail in one concrete embodiment, with reference to accompanying FIG. 1 which schematically illustrates a precipitation hardening cycle for one preferred embodiment of the method according to the present invention.

DESCRIPTION OF PREFERRED EMBODIMENT

As starting material, use is made of an AlZnMgCu alloy designated AA7075, for the production of a high-strength aluminium material object. The material is, for example, intended for machine parts in the sealing unit of a packing and filling machine of the above-described type. In order to meet the requirements of strength, precipitation hardening for hardening to T6 or T7 is to be carried out. The processed and formed aluminium material object should first be prepared for surface treatment by means of adhesion-promoting measures, for example suitably by first heating the aluminium surface to approx. 400° C. for burning off fat molecules and other organic residues (a) and subsequently sand blasting the surface (b). The precipitation hardening process proper is subsequently carried out in accordance with the present invention in connection with surface coating and sintering of a protective layer of a PTFE-based composition with a high melting point, such as, for example, "Accolan Silver"® from the "Accoat Group".

The polymer is applied on the aluminium material object prepared for precipitation hardening at room temperature (c), by means of thermal spray coating, i.e. by melting granules or powder of the polymer composition, for example with a flame, and spray-applying the molten material on the surface of the aluminium material. The polymer is applied to a suitable thickness of approx. 10–120 $\mu$m, preferably approx. 20–60 $\mu$m and most preferably approx. 40 $\mu$m.

The polymer-coated aluminium object is thereafter heated to solution temperature during a relatively short time (d). The heating cycle may possibly take place in two or more stages (e) so as to avoid blister formation in the polymer layer. When the material has reached a temperature of approx. 420° C., it is kept at this temperature for a stay time of approx. 15 minutes (f). It is essential for the final properties of the material that aluminium alloys of the 7075 type are heated for solution treatment to approx. 420° C. (at least 415° C.), see "ASM Specialty Handbook—Aluminum and Aluminum Alloys", pp. 300–301, FIG. 6. During the stay time, the alloy atoms are dissolved in the aluminium material at the same time as the polymer is melted/sintered fast on the surface of the aluminium object.

At the end of the stay time, the object is rapidly cooled to room temperature with water or air, preferably water (g). The cooling operation takes place at a speed of at least 300° C./s, and the object is then retained in cooling water for approx. 60 minutes (h).

Before the artificial ageing stage is commenced, the object may possibly be allowed to cold age during a brief period of time at room temperature in air for approx. 150 minutes (i), higher final strength being thus obtained. Extremely high strength will, however, be obtained even if the above-mentioned cold ageing in air is dispensed with.

Finally, the aluminium material object is artificially aged preferably at at least approx. 150° C. for approx. 24 hours for the final precipitation hardening (g), whereby the hardening degree T7 is achieved. An artificial ageing temperature of approx. 120° C. also functions well and possibly provides a harder material but with lower resistance to stress corrosion (hardening degree T6). Artificial ageing at approx. 150° C. realises a material with satisfactory hardness for the above-mentioned specific practical application and good resistance to stress corrosion.

The above-described, specifically selected alloy compositions and coating polymers merely constitute examples among many other conceivable alternatives, and it will be obvious to a person skilled in the art that numerous modifications and variations may be put into effect without departing from the inventive concept of the method according to the present invention as this is defined in the appended claims. Alloys are adapted and precipitation hardened using technologies known to persons skilled in the art, taking into account the requirements placed on the material in use.

As will have been apparent from the foregoing description, the present invention thus realises a novel method of surface treating, by polymer coating, and improving the corrosion resistance in objects of high-strength aluminium and, at the same time, maintaining the superior mechanical properties and high strength of the material.

What is claimed is:

1. A method of coating and precipitation hardening an aluminium alloy object, the method comprising:

providing at least one layer of a protective polymer material which comprises a fluorine-containing polymer on a surface of the aluminium alloy object thereby forming a coated aluminium alloy object; and heating the coated aluminium alloy object to an elevated temperature of at least approximately 420° C., causing constituents of the aluminium alloy to merge into a solution and causing the polymer material to sinter or melt fast to the surface of the aluminium alloy object thereby forming a strongly-adhered, permanent corrosion resistant coating.

2. The method as claimed in claim 1, wherein the aluminium object is coated with polymer before being heated to the temperature solution treatment.

3. The method as claimed in claim 1, wherein the aluminium object is coated with polymer while being, or after having been heated, to the elevated temperature.

4. The method as claimed in claim 1, wherein the polymer is coated in two or more layers.

5. The method as claimed in claim 1, wherein the polymer substantially comprises PTFE.

6. The method as claimed in claim 1, wherein the polymer composition is coated by means of thermal spraying.

7. The method as claimed in claim 1, wherein the aluminium object is heated in two stages to reach the elevated temperature.

8. The method as claimed in claim 1, wherein the polymer coating is sintered or melted fast on the aluminium object during a stay time at the elevated temperature of approximately 15 minutes.

9. The method as claimed in claim 1, wherein the aluminium object, after solution treatment at the elevated temperature, is rapidly cooled to room temperature and thereafter precipitation hardened by means of artificial ageing at approx. 150° C. for approx. 24 hours.

10. The method as claimed in claim 9, wherein the aluminium object, prior to artificial ageing, is aged at room temperature for approx. 150 minutes.

11. The method as claimed in claim 1, further comprising:

cooling the coated aluminium object from the elevated temperature; and ageing the coated aluminium alloy object.

12. The method of claim 1, wherein the polymer material has a composition such that, upon sintering, the polymer stratifies to the surface of the aluminium alloy object, thereby promoting adhesion and hardness.

13. An aluminium object coated with polymer and surface treated, produced by means of the method as claimed in claim 1.

* * * * *